United States Patent [19]

Roorda

[11] Patent Number: 4,613,790

[45] Date of Patent: Sep. 23, 1986

[54] TOUGH-RESPONSIVE ELECTRIC LIGHT SOCKET

[75] Inventor: John W. Roorda, El Cajon, Calif.

[73] Assignee: Westek Associates, San Diego, Calif.

[21] Appl. No.: 740,990

[22] Filed: Jun. 4, 1985

[51] Int. Cl.[4] ..... H01J 7/44

[52] U.S. Cl. ..... 315/72; 307/116; 307/157; 315/194; 315/208; 315/362; 315/363; 315/DIG. 4

[58] Field of Search ..... 315/72, 362, DIG. 4, 315/208, 363, 194; 307/116, 157; 323/904

[56] References Cited

U.S. PATENT DOCUMENTS

| | | | |
|---|---|---|---|
| 3,147,928 | 9/1964 | Carpenter | 307/157 |
| 3,715,623 | 2/1973 | Szabo | 315/194 |
| 4,101,805 | 7/1978 | Stone | 315/74 |
| 4,163,923 | 8/1979 | Herbers et al. | 315/208 |
| 4,211,959 | 7/1980 | Deavenport | 315/362 |
| 4,556,824 | 12/1985 | Cheng | 315/363 |

*Primary Examiner*—Harold Dixon

*Attorney, Agent, or Firm*—Brown, Martin & Haller

[57] ABSTRACT

A touch-responsive socket for receiving an electric light bulb and controlling the power delivered to the bulb in response to the touching of an electrically-conductive member includes a housing with a touch-responsive electrical circuit disposed in it between a light socket shell and a mounting base. The mounting base is assembled from electrically dissimilar base portions. An electrically-nonconductive base portion provides support for power conductors and means for connecting the circuit to the conductors. An electrically-conductive base portion, which fits to the nonconductive base portion, provides electrical conductivity between a touch-control signal input to the touch-control circuit and an electrically-conductive member that is touched to control the illumination of an electric light bulb in the socket shell. The assembled base portions are mountable to a lamp base on which the electrically-conductive member is disposed so that it can be touched by a user of the lamp to control the illumination delivered by the bulb.

20 Claims, 11 Drawing Figures

TOUGH-RESPONSIVE ELECTRIC LIGHT SOCKET

BACKGROUND OF THE INVENTION

The present invention lies in the field of electric lamps in which power to an electric bulb is controlled by touching the lamp. The invention particularly concerns a light bulb socket for use in such a lamp that encloses a touch-responsive electrical circuit for controlling the delivery of AC power to a light bulb held in the socket.

In the prior art, electric lamps have been provided with electronic circuits that control delivery of power to an electric lamp bulb in response to a user's touching the lamp or a conductive member mounted on the lamp.

Electronic circuits that respond to the touching of a lamp to control power delivered to a lamp bulb are well known and conventionally include electronic circuitry that provides, in response to touching a lamp or a conductive member, electronic signals that control the firing angle of a thyristor or other three-port power semiconductor. In such a circuit the thyristor is connected between a source of AC power, such as an electrical power cord, and the socket into which a light bulb is threaded. The circuit includes touch control circuitry which senses a change in capacitance, conductivity, or inductance that occurs when the lamp is touched by providing firing angle control signals to the thyristor. Touch-control circuitry conventionally includes multistate circuitry that transitions from state to state under the control of a sequence of touch inputs. In such circuitry, each state causes an associated firing angle signal to be delivered to the thyristor. This provides the touch circuit with the ability to switch varying levels of power to the bulb by controlling the amount of power conducted by the thyristor. A lamp user is thereby enabled to select varying levels of illumination and to turn the lamp on and off.

In order to permit the conversion of lamps controlled by mechanical switches to provide touch-control of bulb illumination levels, conventional light socket structures have been adapted to receive a touch circuit. For example, a conventional socket structure includes an upper portion for receiving the threaded portion of an electric bulb. A closed lower portion houses a switch assembly to switch power to the bulb. The socket is converted to touch-control by housing the touch-control circuit in the lower closed portion of the socket. Then, the attachment of the conventional socket containing the touch circuit to a lamp mounting post completes the conversion of the lamp to incorporate the touch-control feature.

However, it is a difficult and lengthy task to convert a conventional socket to provide the space that is necessary to accommodate all of the physical features of a touch responsive circuit. For example, a touch-responsive circuit must include electronic elements for converting conventional domestic AC power to DC power for circuit operations; as is known, such conversion circuitry characteristically includes discrete semiconductor elements such as diodes and a large capacitor. Further, safety regulations require isolation of the touch circuitry from the lamp in order to eliminate the possibility of electric shock, with the isolation typically provided by another large capacitor. Finally, the power conversion and electronic signal switching taking place in the touch control circuit generate radio frequency interference that can affect the operation of nearby receivers such as radios. Suppression of such interference is accomplished by filtration circuitry having a significant size.

In sum, the volume required to accommodate touch circuitry is difficult, if not impossible, to provide by adaptation of a conventional socket; there is simply too little available space inside the socket assembly to comfortably accommodate a touch circuit.

Further, a conventional bulb socket assembly is not adapted for dissipating the heat generated in the controlled semiconductor element providing power to the bulb. The volume available to mount a touch circuit in a conventional socket is normally closed, thus preventing cooling by conduction. Moreover, since the socket assembly portion in which the touch control circuit may be located is used for providing a touch control input to the circuit, the power conducting element must be electrically isolated from it, thus reducing the socket's effectiveness as a heat sink.

Therefore, it is evident that there is a need for a touch control electric light socket assembly that will provide the space and operational features necessary for incorporating a touch-responsive electric circuit used to control the provision of power to a light bulb.

SUMMARY OF THE INVENTION

The advance provided by the touch-responsive socket assembly of the present invention over existing touch-responsive sockets is the provision of a structure that accommodates a touch-responsive electric circuit with the mechanical and electrical features necessary for the effective operation of the circuit. This advance addresses the problem of concurrently providing for connecting the circuit to a power source, providing a touch-controlled input signal path that is electrically isolated from the circuit power connection, and providing for the dissipation of heat generated by power-conducting elements of the circuit.

The solution to the problem is realized in a touch-responsive electric light socket assembly including a non-conductive, elongate, substantially tubular housing having two open ends. A socket shell assembly is held in the housing adjacent a first one of the open ends to receive the threaded end of an electric light bulb. A touch-responsive circuit module is disposed in the housing between the open ends and is connected to the socket shell for delivering electrical power to the socket shell in response to a powercontrol signal produced by the tuching of an electrically-conductive member. The other end of the tubular housing fits to a base member which supports the housing on a lamp base. The base member includes a first base member portion that supports an electrical power cord in conducting contact with the touch-responsive circuit and a second base portion that provides electrical conductivity between the touch-responsive circuit and an electrically-conductive member which is touched to provide a power-control signal to the circuit. The housing is vented at both ends to provide convective cooling of heat-generating electrical power-conducting circuit elements.

It is therefore an object of the present invention to provide a touch-responsive electric light socket assembly having the capacity to effectively accommodate a touch-control circuit.

It is a further object of the present invention to provide an improved touch-responsive electric light socket assembly.

Other objectives and attendant advantages of the present invention will become more apparent when the following detailed description is read in view of the below-described drawings.

DETAILED DESCRIPTION OF THE PREFERRED EMBODIMENT

Figure 1:
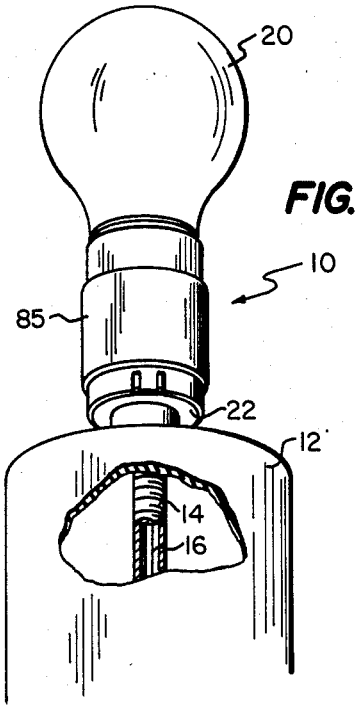
FIG. 1 illustrates the operational setting of the socket assembly of the invention.

With reference now to FIG. 1, the socket assembly of the invention, indicated generally by 10, is mounted on a lamp base 12 by attachment to a threaded mounting rod 14.

As is typical, the rod 14 is hollow and provides a cental bore through which a power cord 16 runs. One end, not shown, of the power cord 16 can be plugged into a wall socket for connection to a power bus conducting conventional domestic AC power. The other end of the power cord is connected to a touch circuit assembly, discussed below. The touch circuit assembly includes typical circuitry that responds to the touching of an electrically-conductive member such as the lamp base 12 or a conductive strip attached thereto, by switching AC power to a light bulb 20 to which the module is electrically connected.

The touch-control module contains conventional, well-understood digital circuitry embodying a multi-state transition cycle. Power conducting circuitry is contained on the touch-control module tht responds to the multi-state transition cycle by switching varying levels of AC power to the bulb 20. For example, such a multi-state cycle can include a first state in which no power is delivered to the bulb 20. A first touch on the lamp base 12 will cause the cycle to transition to a second state providing a first level of power to the bulb 20. Second and third touches will move the transition cycle through third and fourth states, respectively, in each of which the level of power delivered to the bulb 20 will increase over the previous state. Finally, a fourth touching of the lamp base 12 or a conductive member attached thereto will return the cycle to its first state, disconnecting the bulb 20 from the power record 16.

Touch-responsive circuits for controlling bulb power levels are well understood in the art. One such circuit is taught, for example, in the Szabo U.S. Pat. No. 3,715,623, still another touch circuit module for use in a lamp socket is illustrated in U.S. Pat. No. 4,101,805 to Stone.

Figure 3:
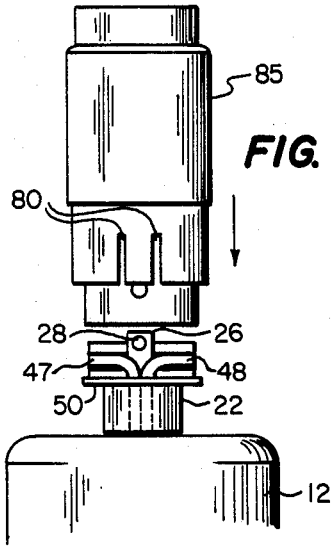
FIG. 3 is a front view of the socket assembly of the invention illustrating the assembly relationship of a socket assembly base member and the upper portion of the socket assembly.
Figure 4:
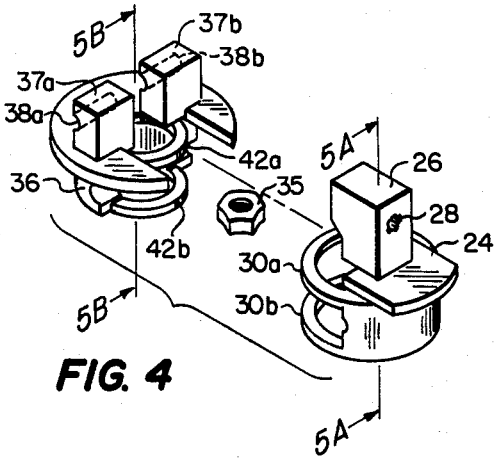
FIG. 4 is an enlarged exploded view of the base member of the socket assembly.
Figure 2:
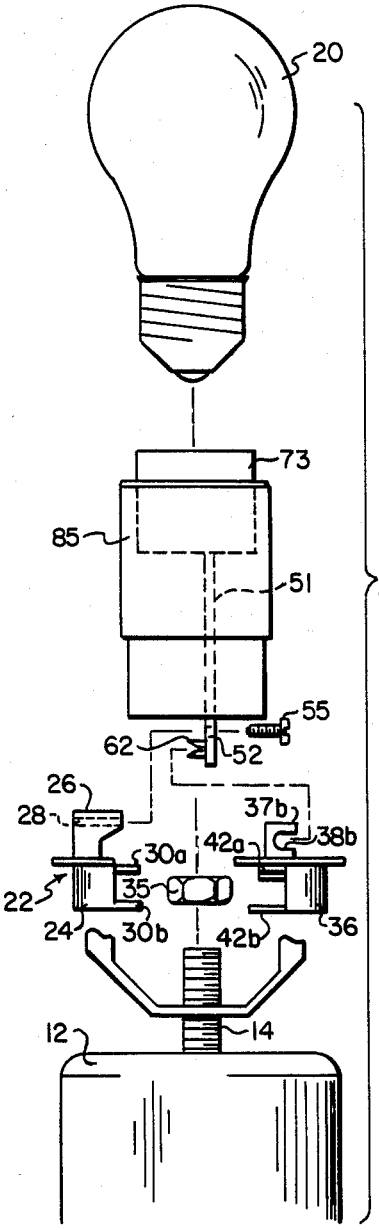
FIG. 2 is an exploded assembly view of the socket assembly of the invention.

The structure and operation of the socket assembly 10 can be understood with reference to FIGS. 2–4. The socket assembly includes a socket base 22 (FIGS. 4, 5A, and 5B) that has a first base portion 24 formed from an electrically-conductive material such as carbon-filled ABS. The base portion 24 has an upwardly extending mounting flange 26 through which is formed a threaded hole 28. A pair of annular assembly flanges **30*a* and 30*b* extend outwardly from the conductive base portion 24 in a direction perpendicular to the mounting flange 26. The base portion 24 also includes a flange receptacle 32 that receives, in close frictional engagement, a flange from another base portion when the socket assembly base member 22 is assembled. The conductive base portion 24 also includes a recess 34 that forms a portion of a chamber. The purpose of the chamber is to receive a steel attachment nut 35** which threads onto the lamp mounting rod to mount the socket assembly to a lamp.

A second socket base assembly portion 36 is formed from an electrically-nonconductive (insulating) material and includes a pair of spaced flanges **37*a* and 37*b* into which are cur grooves 38*a* and 38*b*, respectively. A plurality of slots, one indicated by 40, are cut into each of the upright flanges 37*a* and 37*b* through the respective grooves 38*a* and 38*b*. On the bottom of the nonconductive base portion 36 are formed a pair of annular assembly flanges 42*a* and 42*b* and a pair of flange receptacles 44*a* and 44*b*. A recess 46 is also formed in the lower part of the nonconductive base portion 36. The recess 46 cooperates with the recess 34 in the base portion 24 to form the chamber that encloses the attachment nut 35**.

As seen in FIGS. 2 and 4, the socket base assembly 22 is assembled when the conductive base portion 24 is brought together with the nonconductive base portion 36 so that the annular assembly flanges **30*a* and 30*b* of the portion 24 enter the flange receptacles 44*a* and 44*b* in the portion 36, and the annular assembly flange 42*a* of the nonconductive base portion 36 enters the flange receptacle 32 of the conductive base portion 24**.

Thus assembled, the annular assembly flanges **30*a*, 30*b*, and 42*a* are seated in close frictional engagement with the flange receptacles 44*a*, 44*b*, and 32, respectively. In addition, the annular assembly flange 42*b* engages the bottom of the conductive base portion 24**.

All of the assembly flanges **30*a*, 30*b*, 42*a*, and 42*b* have holes bored in them to permit the threaded mounting rod 14 to extend up through the socket base 22 so that its upper tip is adjacent the bottom of the mounting flange 26 and the upright flanges 37*a* and 37*b*. The annular assembly flanges provide the base portions 24 and 36 with communicating openings adjacent the upright and mounting flanges so that the power cord 16 can extend up through the mounting rod 14 and be fed through the socket base 22. As best seen in FIG. 3, the power cord 16 consists of a pair of jacketed power conductors 47 and 48 that can be pulled apart, trimmed, and flared to lie in the grooves 38*b* and 38*a*, respectively, in the nonconductive base portion 36**. Referring again to FIG. 2, the socket base 22 is secured to the lamp base 12 by means of the attachment nut 35 which is threaded onto the mounting rod 14 and enclosed in the chamber formed by the chamber portions 34 and 46 when the base portions 24 and 36 are brought together. The chamber is dimensioned to fit in close frictional engagement with the attachment nut 35 to provide a firm, stable base for mounting the rest of the socket assembly 10 to the lamp base 12.

When joined, the conductive and nonconductive base portions 24 and 36 provide a continuous annular flange 50 on the socket base 22. The flange 50 provides an attachment point for another portion of the socket assembly explained below.

Figure 6:
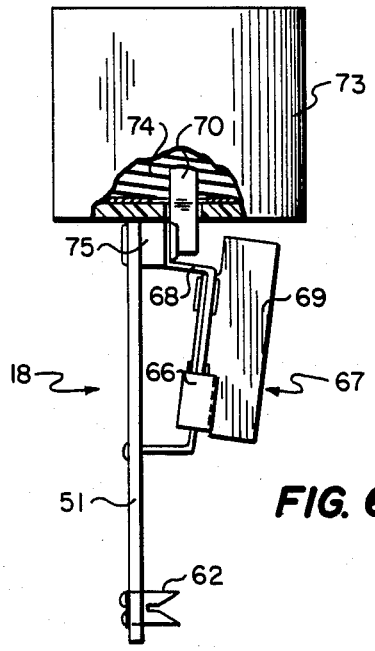
FIG. 6 is a side view illustrating the assembly relationship of a touch-control electronic module and a socket shell.
Figure 7:
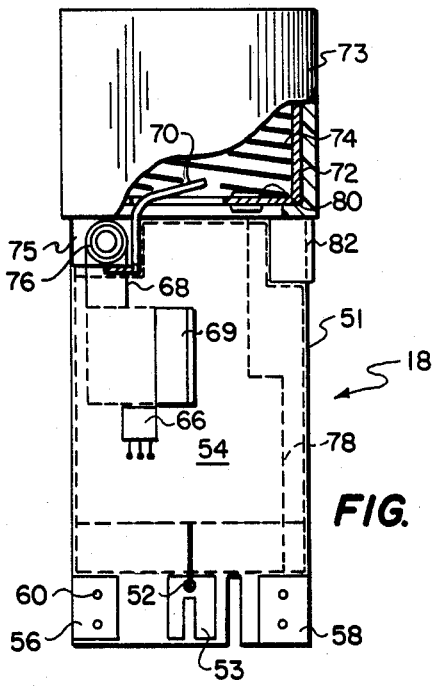
FIG. 7 is a front view of the assembly relationship illustrated in FIG. 6.

With reference now to FIGS. 6 and 7, the upper portion of the touch-responsive socket assembly 10 can be understood. The upper portion of the socket assembly 10 consists of a touch circuit module 18, a socket shell 72, and a socket shell cup 73. Preferably, the touch circuit module 18 comprises a conventional printed circuit board (PCB) 51 that is conventionally fabricated to provide solder mounting and circuit interconnections for the electronic and electrical circuitry performing the conventional touch circuit functions described hereinabove. The PCB 51 includes a hole 52 that is electrically conductively continuous with a touch-control signal path input pad 53 that provides the primary input path for touch-control signals to be conducted to the touch-control circuitry indicated generally by the block 54.

Since touch-control circuits are conventional and wellknown in the art, a detailed description of the circuit 54 is unnecessary. Therefore, individual components of the circuit 54 are not illustrated herein, with the sole exception of a power-conducting component described below. An exemplary PCB-mounted touch-control circuit modularized for use with a touch-control socket is taught in U.S. Pat. No. 4,211,959.

As illustrated in FIG. 2, the lower portion of the PCB 51 is secured to the socket base 22 by a threaded screw 55 which threads through the hole 52 in the PCB 51 and the threaded hole 28 in the mounting flange 26 of the conductive base portion 24. Thus a continuous electrically-conductive path is provided from the input signal pad 53 through the screw 55, the mounting flange 26, the conductive base portion 24, and attachment nut 35 that is held in close physical contact with the lower assembly flange 30*b* of the conductive portion 24, and the mounting rod 14.

A means for providing an electrically-conductive touch input surface can be provided by, for example, a strip of conductive material on the lamp base 12 that is in electrically conductive contact with the rod 14. Alternatively, the base 12 could be formed from an electrically-conductive material to which the rod 14 is threaded. Finally, a lamp with a ceramic base can be coated with a clear electrically-conductive compound with provision for providing a conductive pathway between the coating compound and the mounting rod 14.

Referring again to FIGS. 6 and 7, AC power is provided to the circuit 54 through a pair of power contact solder pads 56 and 58 on either side of the signal path pad 53 on the PCB 51. Each of the power contact pads is connected by a conventional circuit path to respective portions of the circuit block 54. Each of the pads 56 and 58 has a pair of holes (one indicated by 60 in FIG. 7), through which a pin, such as pin 62, with a pair of tines can be inserted, with the pin being soldered to its respective pad.

Figure 5B:
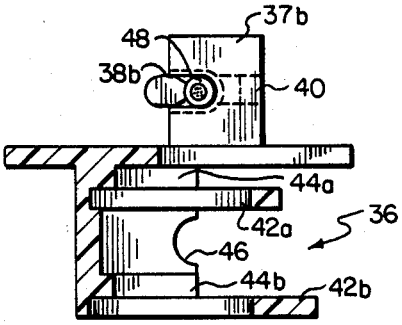
FIG. 5B is an enlarged side sectional view of an electrically nonconducting base member portion taken along B—B in FIG. 4.
Figure 5A:
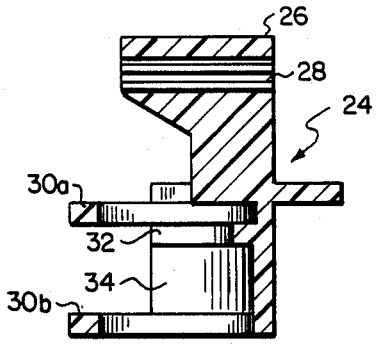
FIG. 5A is an enlarged side sectional view of an electrically conducting base member portion taken along A—A in FIG. 4

Now, with reference to FIGS. 2, 5B, and 6, when the lower portion of the PCB 51 is attached to the socket base 22 by means of the screw 55, the tines of each of the pins 62 are pressed through the insulating jacket of a respective one of the power conductors 47 and 48 to make electrical contact therewith and to assist in securing the lower portion of the PCB 51 to the socket base 22 for stability of the socket assembly 10. The tines of each of the pins extend through a power conductor jacket, making electrical contact with the power conductor embedded therein, and into the slots 40 on the upright flanges 37*a* and 37*b*. Penetration of a power conductor insulating jacket and a pair of slots by its tines insures that each of the pins will be securely held by the socket base 22.

Referring now to FIGS. 6 and 7, power is conventionally provided by the circuit 54 to the socket shell 72 from a "hot" pad of the power contact pads 56 and 58 through a thyristor device such as an SCR (silicon-controlled-rectifier) 66. As stated above, the SCR 66 is the only component of the circuit 54 illustrated herein. However, it is to be understood that other circuit components, not shown, would also be mounted to the PCB 51.

The firing angle of the SCR 66 is conventionally controlled by control circuitry in the circuit 54 that executes a sequence such as the above-described multistate sequence in response to touch signals received through the signal pad 53. The AC power is conducted from the SCR 66 through an electrically-conductive heat sink assembly 67 including a "hot" power contact 68, a heat sink flange 69, and a contact tip 70. The "hot" contact 68 and the flange 69 are in physical contact with the SCR 66 to dissipate heat generated thereby when conducting power to the socket shell 72. The contact tip 70, shown in FIG. 7, is folded over to provide a "hot" contact surface for contacting the bottom conductor of a light bulb screwed into the socket shell 72.

The socket shell 72 is enclosed and retained in a shell cup 73 formed from an electrically insulating material such as plastic. The shell cup 73 is riveted to the socket shell 72 to ensure secure, stable seating of the socket shell in the shell cup.

The socket shell 72 and shell cup 73 are both slotted to receive the contact tip 70, and the socket shell floor is conventionally formed of an insulating material to electrically isolate the contact tip 70 from the conductive, threaded interior surface 74 of the socket shell 72. The conductive, threaded interior surface 74 receives and engages the threaded end of a light bulb such as the bulb 20.

A mounting block 75 is formed on the bottom of the shell cup 73 to provide an electrically insulating point to physically anchor the power contact 68. The power contact 68 is secured to the PCB 51 and to the shell cup 73 by means of a rivet 76 whose ends sandwich the contact 68, the mounting block 75, and the PCB 51.

A power return path is provided from the socket shell 72 to the circuit 54 by a power conductor 78, shown in dotted outline form in FIG. 7, that extends from the contact pad 58 to a return contact rivet 80 that secures the socket shell 72 to the shell cup 73. The rivet 80 is one of a pair, the other of which is not shown.

A retention flange 82 is also formed in the bottom of the shell cup 73 and includes an interior slotted recess, now shown, that accepts and retains an edge of the PCB 51 to further insure a stable and secure physical connection between the PCB 51 and the shell cup 73.

Figure 8:
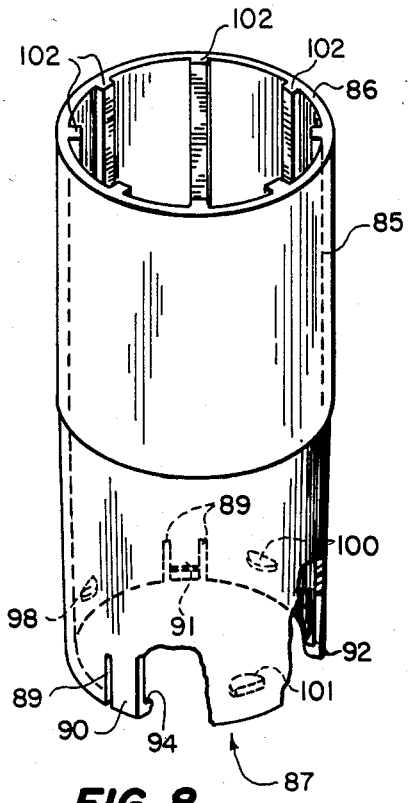
FIG. 8 is a perspective view of a socket housing partially cutaway.
Figure 9:
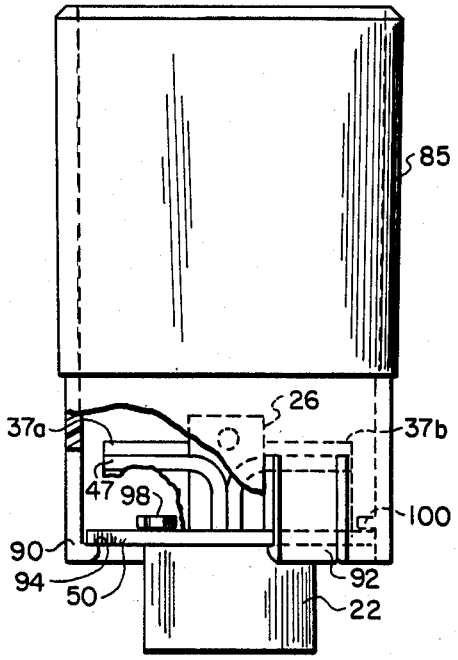
FIG. 9 is an enlarged side sectional view of the bottom of the socket housing engaging the base member.
Figure 10:
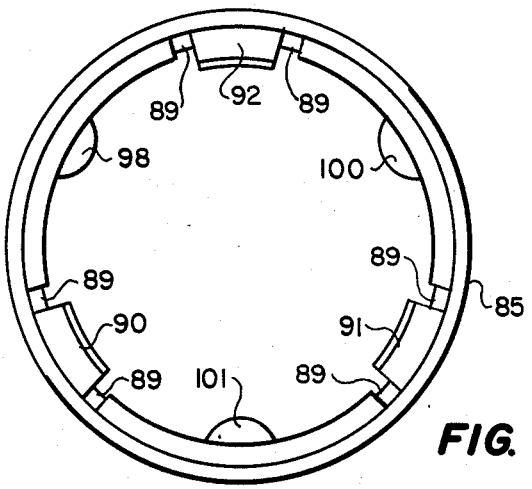
FIG. 10 is a plan view of the bottom opening of the socket housing.

As shown in FIGS. 1-3, the socket assembly 10 includes an outer tubular housing 85 that is formed from a nonconductive material, which may be a moldable material such as plastic. Referring now to FIGS. 8-10, the housing 85 includes a top opening 86 through which the socket cup 73 extends and a bottom opening 87 through which the PCB 51 extends. The interior of the housing 85 has an interior diameter that decreases gradually in the direction from the opening 86 to the opening 87. In addition, the bottom portion of the housing 85 adjacent the bottom opening 87 has three sets of circumferentially distributed slots 89, each forming an attachment flange. The three attachment flanges are indicated by reference numerals 90-92. As is shown in FIGS. 8 and 10, the bottom of each atttachment flange includes an inwardly directed projection such as the projection 94 on flange 90. In addition, three retention knobs 98, 100, and 101 are formed on the inner surface of the housing 85 above the lower opening 87.

With reference now to FIGS. 2, 3, and 8-10, the socket assembly 10 is assembled by mounting the socket base 22 to the threaded mounting rod 14 as described above and placing the power conductors 47 and 48 in their respective grooves in the nonconductive base portion 36. The PCB 51 is then attached as described above to the socket shell 73 and the housing 85 is slid upwardly over the assembled socket shell 73 and PCB 51.

The base assembly 22 is assembled and secured to the mounting rod 14 by the nut 35. The lower portion of the PCB 51 is then secured electrically and physically as described above to the base assembly 22 by means of the screw 55 and the pins 62. The housing 85 is then slid downwardly toward the annular flange 50 until the inward projections of the attachment flanges such as the projection 94 have snapped over and grasped the bottom of the annular flange 50. As shown in FIGS. 8 and 10, the housing 85 is immobilized on the base assembly 22 by the engagement of the lower projections of the attachment flanges to the lower surface of the annular ring 50 and the engagement of the knobs 98, 100, and 101 on the annular ring's upper surface.

In addition, as seen in FIGS. 8 and 10, the inner diameter of the housing 85 adjacent the lower opening 87 reduces to a dimension substantially equivalent to the width of the PCB 51 at that point, thus ensuring a stable physical seating of the lower portion of the housing 85 against the PCB 51. Finally, ribs 102 are formed on the upper portion of the inner surface of the housing 85. The ribs project toward the center of the housing 85 and are for the purpose of supporting the upper portion of the housing 85 against the shell cup 73. The ribs 102 and the slots 89 in the lower portion of the housing 85 permit air to circulate through the interior of the socket assembly 10 and convectively cool the SCR 66 and the flange 69.

The vertical disposition of the PCB 51 in the housing 85 above the base 22 permits the circuit board to have a greater surface area than if the board were disposed parallel to the flange 50, for example. Thus, the PCB 51 permits greater spacing between circuit components than is available in prior art touch sockets where a PCB is mounted parallel to the plane of support of a lamp in the bottom portion of the socket. This aids in circuit cooling, accommodation of large components, and placement of components for reduction of electromagnetic interference.

The use of the slidably-mounted housing 85 to enclose the socket cup 73, PCB 51, and base 22 permits easy access to the interior of the socket assembly 10 for servicing and part replacement. When such access is needed, the housing is removed by prizing the attachment flanges away from the base annular flange 50 and sliding the housing upwardly toward the socket cup 73.

Obviously many modifications of the above-described touch-responsive electric lamp socket assembly are possible in light of the above teachings, and it is therefore to be understood that the invention may be practiced otherwise than as specifically described.

I claim:

1. A touch-responsive electric light socket assembly, comprising:

an electrically-nonconductive, elongate, substantially tubular housing having two opposing open ends;

a socket shell means held in said housing adjacent a first one of said open ends for receiving the threaded end of an electric light bulb;

a touch-responsive circuit module disposed in said housing between said open ends and connected to said socket shell means for delivering electrical power to said socket shell in response to a power-control signal produced by a touch-control signal source;

a base member for fitting to said second housing end to support said housing on a lamp base;

first base means forming a first part of said base member for providing an electrically-conductive touch-control signal pathway to said touch-responsive circuit from a touch-control signal source; and second base means forming a second part of said base for supporting an electrical power cable in conducting contact with said touch-responsive circuit and for electrically isolating said power cable from said electrically-conductive touch-control signal pathway.

2. The touch-responsive socket of claim 1 further including firt securing means for anchoring said touch-responsive circuit module to said base member and second securing means for anchoring said touch-responsive circuit module to said socket shell means.

3. The touch-responsive socket of claim 1 wherein said first means is formed from an electrically-conductive material and includes a chamber portion for receiving an electrically-conductive attachment device.

4. The touch-responsive socket of claim 1 wherein said second base means is formed from an electrically insulating material and includes a pair of oppositely-directed grooves, each for receiving a respective one of a pair of power conductors.

5. The touch-responsive socket of claim 3 wherein said second base means is formed from an electrically insulating material and includes a pair of oppositely-directed grooves, each for receiving a respective one of a pair of power conductors.

6. The touch-responsive socket of claim 1 wherein said first base means includes a first chamber portion, a first flange for fitting to a shaped cavity, and a first shaped cavity for receiving another flange.

7. The touch-responsive socket of claim 6 wherein said second base means includes a second chamber portion that forms, with said first chamber portion, a chamber for enclosing a nut threaded to a socket support assembly, a second flange for fitting into said first shaped cavity, and a second shaped cavity for receiving said first flange.

8. The touch-responsive socket of claim 2 wherein said second securing means includes a heat sink assembly for dissipating heat generated on said touch-responsive circuit.

9. The touch-responsive socket of claim 2 wherein said second base means is formed from an electrically insulating material and includes a pair of oppositely-directed grooves, each for receiving a respective one of a pair of power conductors.

10. The touch-responsive circuit of claim 9 wherein said first securing means includes a pair of pins, each attached to said touch-responsive circuit module, and, when said module is fitted to said base member, extending into a respective one of said grooves for penetrating the jacket of a respective power conductor contained in said respective groove.

11. A touch-responsive electric light socket, comprising:

a socket assembly for receiving the threaded end of an electric light bulb;

an elongate touch-responsive circuit board module connected to said socket assembly for delivering power to said socket assembly in response to a touch-control input signal;

a base module attached to said touch-responsive circuit board module for supporting said socket on a lamp base;

first base means forming a first part of said base member for providing a touch-control input connection between said touch-responsive circuit board module and a touch-control signal source on a lamp to which said socket is mounted;

second base means forming a second part of said base for supporting an electrical power cable in conducting contact with said touch-responsive circuit module and for electrically isolating said power cable and said electrically-conductive touch-control signal pathway; and a tubular housing for slidably fitting over and enclosing said socket assembly, touch-responsive circuit board module, and base member and having engagement means for releasably attaching to said base member.

12. The touch-responsive socket of claim 11 further including first securing means for anchoring said touch-responsive circuit board module to said base member and second securing means for anchoring said touch-responsive circuit to said socket assembly.

13. The touch-responsive socket of claim 11 wherein said first base means is formed from an electrically-conductive material and includes a chamber portion for receiving an electrically-conductive attachment device.

14. The touch-responsive socket of claim 11 wherein said second base means is formed from an electrically insulating material and includes a pair of oppositely-directed grooves, each for receiving a respective one of a pair of power conductors.

15. The touch-responsive socket of claim 13 wherein said second base means is formed from an electrically insulating material and includes a pair of oppositely-directed grooves, each for receiving a respective one of a pair of power conductors.

16. The touch-responsive socket of claim 11 wherein said first base means includes a first chamber portion, a first flange for fitting to a shaped cavity, and a first shaped cavity for receiving another flange.

17. The touch-responsive socket of claim 16 wherein said second means includes a second chamber portion that forms, with said first chamber portion, a chamber for engaging a nut threaded to a socket support assembly, a second flange for fitting into said first shaped cavity, and a second shaped cavity for receiving said first flange.

18. The touch-responsive socket of claim 12 wherein said second securing means includes a heat sink assembly for dissipating heat generated by circuit components mounted on said touch-responsive circuit board module.

19. The touch-responsive socket of claim 12 wherein said second base means is formed from an electrically insulating material and includes a pair of oppositely-directed grooves, each for receiving a respective one of a pair of power conductors.

20. The touch-responsive circuit of claim 19 wherein said first securing means includes a pair of pins, each attached to said touch-responsive circuit module, and, when said module is fitted to said base member, extending into a respective one of said grooves for penetrating the jacket of a respective power conductor contained in said respective groove.

* * * * *

UNITED STATES PATENT AND TRADEMARK OFFICE

CERTIFICATE OF CORRECTION

PATENT NO. : 4,613,790

DATED : September 23, 1986

INVENTOR(S) : JOHN W. ROORDA

It is certified that error appears in the above-identified patent and that said Letters Patent is hereby corrected as shown below:

Column 9, line 27, Claim 11, delete "module" and insert therefor --member--.

Signed and Sealed this

Third Day of February, 1987

*Attest:*

DONALD J. QUIGG

*Attesting Officer*

*Commissioner of Patents and Trademarks*